United States Patent [19]
Anoshko et al.
[11] 4,275,579
[45] Jun. 30, 1981

[54] APPARATUS FOR MANUFACTURE OF CORRUGATED PIPES

[76] Inventors: Vladimir A. Anoshko, ulitsa Shosseinaya, 58, korpus 1, kv. 84; Eduard M. Godin, ulitsa Begovaya, 22, korpus 3, kv. 212; Anatoly N. Gavrilov, Kutuzovsky prospekt, 43, kv. 118, all of Moscow; Garik E. Zverkov, ulitsa Oktyabrskoi revoljutsii, 24, kv. 40, Smolensk; Vladimir I. Matskevich, Moskovsky prospekt, 66, kv. 45, Tolyatti; Valentin M. Chepurin, ulitsa Starodemidovskaya, 8-b, kv. 28; Valentin P. Semenov, prospekt Stroitelei, 8, kv. 180, both of Smolensk; Vladimir V. Grachev, ulitsa Bobruiskaya, 22, kv. 82, Moscow; Mikhail Y. Butylin, 2 Krasninsky pereulok, 8, kv. 39, Smolensk, all of U.S.S.R.

[21] Appl. No.: 95,672

[22] Filed: Nov. 19, 1979

[51] Int. Cl.[3] ..... B21D 15/06
[52] U.S. Cl. ..... 72/59; 72/385
[58] Field of Search ..... 264/507; 425/387.1, 425/396, 392; 72/59, 385, 61, 62

[56] References Cited

U.S. PATENT DOCUMENTS

| | | | |
|---|---|---|---|
| 1,946,472 | 2/1934 | Babcock | 72/59 |
| 2,217,799 | 10/1940 | Giesler | 72/59 |
| 2,610,667 | 9/1952 | Puster | 72/59 X |
| 2,796,109 | 6/1957 | Wood | 72/59 |
| 2,919,740 | 1/1960 | Poitras | 72/59 |
| 3,099,311 | 7/1963 | Van Leer et al. | 72/59 |
| 3,105,539 | 10/1963 | Johnson | 72/59 |
| 3,429,160 | 2/1969 | Banks | 72/59 |

*Primary Examiner*—Leon Gilden
*Attorney, Agent, or Firm*—Lackenbach, Lilling & Siegel

[57] ABSTRACT

An apparatus for manufacture of corrugated pipes by the plastic working method comprises a stand-mounted assembly for clamping and sealing a pipe blank, devised in the form of two clamps arranged coaxially at a certain distance from each other to insert the pipe blank, and furnished with a hydraulic drive. The apparatus also incorporates a device for axial compression, and tools disposed symmetrically in relation to the direction of compression and reciprocating laterally to said direction for embracing the pipe blank. The apparatus contains a device for feeding shaping fluid into the pipe blank. The hydraulic drive according to the present invention comprises hydraulic cylinders, each having a movable link provided with a through passage and mechanically coupled with the respective clamp. The hydraulic drive includes a double-acting pneumohydraulic booster, the hydraulic chambers whereof communicate with hydraulic cylinder chambers through a hydraulic distribution gear, and the pneumatic chambers whereof communicate with a source of compressed gas. The axial compression device comprises at least one pneumohydraulic booster and a two-position pneumoelectric distribution valve, the outlet whereof communicates with a pneumatic chamber of the pneumohydraulic booster for controlling travel of the other link in one of said hydraulic cylinders which effects axial compression of the pipe blank, and the inlet whereof is connected to the compressed gas source. The shaping fluid feeding device incorporates a two-position hydraulic distribution valve, the inlet whereof communicates with hydraulic chambers of the double-acting pneumohydraulic booster through the distribution gear, and the outlet whereof is connected to a pressure regulator. A hydraulic distribution and adjustment gear connects the pressure regulator to a source of shaping fluid and to the internal space of said pipe blank through the through passage provided in the movable link of the other hydraulic cylinder.

11 Claims, 3 Drawing Figures

APPARATUS FOR MANUFACTURE OF CORRUGATED PIPES

The present invention relates to plastic working of materials, and more particularly, to the apparatus for manufacture of corrugated pipes.

The apparatus according to the present invention can most advantageously be used for manufacture of thin-walled hollow articles having corrugated surface, specifically, the bellows.

The present invention is also applicable for manufacture of thin-walled hollow articles made of pipe blanks, with any surface shape depending on tools which embrace said pipe blank.

At present, various thin-walled corrugated-surface hollow articles are in great demand.

However, the existing machinery for fabrication of corrugated pipes is rather cumbersome and the power requirements are considerable. In addition, said machinery cannot in all cases provide for the desired quality of the ready articles.

Known in the art is an apparatus for manufacture of corrugated pipes, wherein corrugations on the pipe blank surface are formed by a profiled revolving roller. Upon shaping one corrugation on the pipe blank surface, said roller is retracted to the initial position, and the blank is moved through a definite length along the longitudinal axis thereof normal to the roller plane. Then the profiled roller shapes the next corrugation. The pipe blank is clamped by a special chuck, and the roller is introduced inside the pipe blank (cf. U.S. Pat. No. 3,429,160, Cl. 72–77, dated 1969).

The efficiency of the prior-art apparatus is comparatively low since each corrugation is shaped individually. Apart from that, the pipe blanks are sometimes damaged by the revolving profiled roller. The size of the corrugated pipes depends on that of the roller.

Another prior-art apparatus for manufacture of corrugated pipes shows quite a higher efficiency. The pipe blank is clamped between fixed and movable holders and is embraced by profiled tools. The movable holder is provided with a through passage for feeding shaping fluid inside the pipe blank from a hydraulic cylinder, the chamber whereof communicates with a pipe blank internal space. The corrugations are formed after shaping fluid is injected into the pipe blank and an axial load is applied to the blank (cf. U.S. Pat. No. 1,946,472, Cl. 72–59, dated 1934).

Yet, the foregoing apparatus is not always applicable for manufacture of pipes with corrugations of considerable height because the corrugations are sometimes seized or the pipe blank is ruptured.

For further improvement of manufacture of corrugated pipes, an apparatus has been developed wherein the pipe blank is placed between movable and fixed holders and embracing tools. The pipe blank internal space communicates with a hydraulic cylinder, the piston whereof is linked with an axial compression device. As the piston travels in the hydraulic cylinder, shaping fluid fills the pipe blank at a certain pressure. The axial compression device travelling together with the piston shapes the corrugations on the pipe blank surface (cf. U.S. Pat. No. 2,919,740, Cl. 153–73, dated 1960).

The known apparatus permits adjusting the volume of shaping fluid injected into the pipe blank depending upon the axial compression predetermined by a definite program.

However, the required load cannot always be appropriately applied to the pipe blank material with the result that the pipe blank surface becomes buckled and the quality of the ready article is not quite high.

There is known an apparatus for manufacture of corrugated pipes equipped with various actuating members, including a stand-mounted hydraulically-actuated assembly for clamping and sealing a pipe blank, a pipe blank axial compression device, holders with respective tools, and a device for feeding compressed fluid into the pipe blank. Said apparatus also incorporates a fluid replenishment system.

The clamping and sealing assembly serves for proper locating and clamping the pipe blank relative to the tools, and also for precluding leakage of shaping fluid delivered under pressure into the pipe blank.

The clamping and sealing assembly is attached to the stand and is fitted with two clamps that are axially aligned. The clamps are positioned at a certain distance from each other for inserting the pipe blank between the end surfaces thereof. The clamps are disposed in the respective cases rigidly attached to the stand and are movable inside the cases toward each other for clamping and sealing the pipe blank. The clamp end surfaces closely fit the ends of the pipe blank and securely seal the internal space of the pipe blank.

The axial compression device is designed to apply a compressing force to the pipe blank in an axial direction. Since the length of the pipe blank shrinks during shaping, the device moves the clamps toward each other to maintain a constant contact between the clamp and blank end surfaces for sealing the pipe blank internal space wherein shaping fluid is delivered.

The axial compression device comprises a stand-mounted hydraulic cylinder, the rod whereof is rigidly linked with the frame, the side surfaces thereof being bevelled. Said bevelled surfaces act upon the ends of two double-arm levers arranged symmetrically with respect to the hydraulic cylinder axis. The lever fulcrum pins are anchored to the apparatus stand. The other ends of said levers are kinematically linked with the clamps. When the hydraulic cylinder piston is in motion, the cylinder rod moves the bevelled surface frame. Said bevelled surfaces exert a pressure on the ends of the double-arm levers. As the levers turn about their fulcrum pins, the other ends thereof push the clamps and cause them to move toward each other for compressing said pipe blank located between said clamps.

The function of the tools fitted to the holders is to embrace said pipe blank in such a manner that the pipe blank adopts the shape identical to that of the tool during formation corrugations at pressure supplied to the internal space of the pipe blank.

The holders accommodating the tools are movable relative to each other in a plane normal to the axis of said pipe blank. Said tools are set to motion by the hydraulic cylinder wherein the rod is linked to the holder and the case is linked with the apparatus stand. After the pipe blank is compressed between the clamps, the holders with the tools are driven by the hydraulic cylinder and the tools embrace the pipe blank.

The compressed fluid feeding device injects compressed fluid into the pipe blank for shaping the corrugations on the surface thereof.

The shaping fluid feeding device comprises a source of fluid delivered at pressure by a fluid pump which is connected through a hydraulic booster to the internal space of the pipe blank. The shaping fluid is supplied into the pipe blank through a respective open-end axial passage machined in one of the clamps. The hydraulic booster serves for increasing the hydraulic drive fluid pressure built up by the fluid pump driven by an electric motor.

The shaping fluid feeding device also includes a hydraulic adjusting gear incorporating a pressure regulator inserted in parallel with the fluid pump for controlling the pressure of shaping fluid delivered into the pipe blank. After the pump is started, hydraulic drive fluid is supplied into the booster wherefrom shaping fluid is forwarded at a higher pressure into the pipe blank. Air trapped inside the pipe blank is expelled through a passage in the clamp. After air is released, said passage is cut off by a valve provided for the purpose.

The purpose of the fluid replenishment system is to replenish shaping fluid delivered into the pipe blank as some fluid is lost for wetting the pipe surfaces and some leaks out when air is released from the pipe blank.

The fluid replenishment system comprises a pump connected through a check valve to a line laid between the hydraulic booster and the passage in one clamp wherethrough shaping fluid is injected into the pipe blank (cf. U.S. Pat. No. 2,654,785, Cl. 72–28, dated 1972).

The foregoing prior-art apparatus for manufacture of corrugated pipes is rather cumbersome because it incorporates several constant-flow pumps. It is a known fact that fluid supply tanks of pumps must be rated at a capacity sufficient to provide for 2 or 3-minute delivery of said pumps. The use of large-capacity tanks increases the dimensions of the apparatus whereby the productional area cannot be utilized efficiently.

In addition, said apparatus is not quite economically efficient because it is to be furnished with hydraulic drive fluid cooling appliances. Since the pumps are running idle for the most part of the working cycle, much power is drained for heating hydraulic fluid. As the temperature rises, the physical parameters of fluid vary which brings about changes in preadjusted performances of the hydraulic adjusting gear. Said changes in the performances may result in inaccurate operation of the actuating elements of the apparatus and, hence, in faults during manufacture of the corrugated pipes. Installation of the cooling appliances greatly complicates the construction of the apparatus and results in extra energy and service costs.

Apart from that, the prior-art apparatus fails to provide for sufficiently stable pipe corrugation cycles due to high-frequency fluctuations in the hydraulic system during operation of the hydraulic pumps, with the consequence that the quality of the ready articles is not sufficiently high.

The clamping and sealing assembly of the known apparatus is not quite dependable because shaping fluid is corrosive and causes erosion of the clamp locating surfaces inside the cases which results in premature failure of said members.

It is the main object of the present invention to provide an apparatus for manufacture of corrugated pipes, wherein a clamping and sealing assembly hydraulic drive, an axial compression device and a shaping fluid feeding device are constructed so as to cut down the energy and service costs, and to permit manufacture of high-quality corrugated pipes, with the dimensions of the apparatus minimized.

Another object of the present invention is to provide an apparatus for manufacture of corrugated pipes, wherein the assemblies, devices and elements feature a maximum service time.

Another important object of this invention is to design an apparatus for manufacture of corrugated pipes highly dependable in operation.

Yet another important object of the present invention is to provide an apparatus for manufacture of corrugated pipes, the construction whereof is simple, and wherein a single means is used for producing pressure for actuating all the elements of the apparatus.

A further object of this invention is to provide an apparatus for manufacture of corrugated pipes, the construction whereof permits the use of a minimum quantity of fluid in the hydraulic drive, without contact between said fluid and surrounding medium.

With these and other objects in view, an apparatus for manufacture of corrugated pipes is herein disclosed, comprising a stand-mounted pipe blank clamping and sealing assembly in the form of two clamps axially aligned and located at a certain distance from each other for inserting a pipe blank, actuated by a hydraulic drive; an axial compression device for compressing the pipe blank; tools arranged symmetrically in relation to the direction of compression and moving reciprocally across said direction for at least partial embracing of the pipe blank; and a compressed shaping fluid feeding device incorporating a pressure regulator and intended to supply shaping fluid from a fluid source into a pipe blank internal space to form a corrugated pipe, wherein, according to the present invention, the hydraulic drive of the clamping and sealing assembly incorporates hydraulic cylinders, each furnished with a movable link in which a through passage is machined and each mechanically connected to the respective clamp, and a pneumohydraulic double-acting booster whose hydraulic chambers communicate with the respective chambers of said hydraulic cylinders through a hydraulic distribution gear for moving one link in each hydraulic cylinder during clamping and sealing procedure and whose pneumatic chambers are connected to a compressed gas source, whereas said axial compression device comprises at least one pneumohydraulic booster and at least one two-position pneumoelectric distribution valve the outlet whereof is connected to a pneumatic chamber of said pneumohydraulic booster which controls the movement of the other link of one of said hydraulic cylinders for axial compression of the pipe blank and the inlet whereof is connected to said compressed gas source, and said corrugated pipe shaping fluid feeding device incorporates a two-position hydraulic distribution valve the inlet whereof communicates with said hydraulic chambers of said pneumohydraulic double-acting booster through said hydraulic distribution gear and the outlet whereof is connected to said pressure regulator which in turn is connected to said shaping fluid source through said hydraulic distribution gear and to the internal space of the pipe blank through said through passage machined in said movable link of the other hydraulic cylinder.

The foregoing design of the clamping and sealing assembly hydraulic drive of the axial compression device and of the shaping fluid feeding device greatly simplifies the construction of the apparatus because pumps, fluid supply tanks and cooling system are not required, and the size of the apparatus is considerably reduced.

The double-acting pneumohydraulic booster provides for feeding under pressure of hydraulic drive fluid and of shaping fluid, and automatically controls the necessary fluid delivery whereby the power requirements of the apparatus are cut down, and no cooling facilities are necessary for cooling the hydraulic drive fluid.

When any device of the apparatus is idle, the power drain thereof is zero.

The use of the double-acting pneumohydraulic booster permits minimizing the volume of hydraulic drive fluid and precludes its contact with ambient air which is essential for prolonging the service life of the apparatus.

Since no pumps are employed in the apparatus disclosed herein, no high-frequency fluctuations occur and, hence the working cycles are stable, the quality of the ready corrugated pipes is high, and the total service life of the apparatus as a whole is much longer.

With the clamping and sealing assembly devised in the form of hydraulic cylinders, shaping fluid does not affect the mating surfaces of the clamps and hydraulic cylinder cases, whereby the service life thereof is prolonged and operating dependability is improved.

It is expedient that the axial compression device should comprise two single-acting pneumohydraulic boosters with the hydraulic chambers thereof communicating with each other through series-connected hydraulic distribution valve and flow controller, and directly through a hydraulic check valve, the outlet whereof being connected to the hydraulic chamber of the single-acting pneumohydraulic booster, wherein the movable link is kinematically associated with the other movable link of one of the hydraulic cylinders.

The foregoing axial compression device of said design permits adjusting the axial compression rate within definite limits, with said compression rate being a function of the pressure built up inside the pipe blank for maintaining a desired stress of the pipe blank material optimum for quality of the ready articles.

It is furthermore preferable that the hydraulic distribution gear is contrived as a bridge of hydraulic check valves and hydraulic drive fluid/shaping fluid separators, each communicating with the respective hydraulic chamber of the double-acting pneumohydraulic booster, the hydraulic chambers whereof are in their turn connected to the respective chambers in the hydraulic cylinders through said hydraulic distribution gear and through a two-position four-way distribution valve connected to said hydraulic distribution gear bridge of hydraulic check valves.

Said hydraulic distribution gear permits the use of oil as fluid for the hydraulic drive, whereby the service period of the apparatus is extended by excluding the contact between corrosive shaping fluid and the double-acting pneumohydraulic booster parts and control members.

It is preferable that the hydraulic distribution and adjustment gear of the shaping fluid feeding device would comprise a hydraulic drive fluid/shaping fluid separator communicating with a pressure regulator and with the internal space of the pipe blank, and a two-position hydraulic distribution valve communicating with said separator and connected in its turn to a shaping fluid source through a hydraulic pressure reducer.

In the hydraulic distribution and adjustment gear of the present design, oil can be used as fluid for the hydraulic drive without contact between corrosive shaping fluid and said pressure regulator. In addition, there are provisions for replenishment of shaping fluid leaking from said feeding device.

It is equally expedient that the hydraulic drive fluid/-shaping fluid separator be designed as a hydraulic booster with the outlet chamber thereof communicating with the internal space of the pipe blank.

This makes it possible to reduce the dimensions of the double-acting pneumohydraulic booster, with the required shaping fluid pressure built up by the hydraulic booster which can fulfil the functions both of the pressure booster and of the hydraulic drive fluid/shaping fluid separator.

It is furthermore preferable that the apparatus be equipped with a hydraulic accumulator, with the hydraulic chamber thereof communicating with the hydraulic chambers of the double-acting pneumohydraulic booster through controlled hydraulic valves, and with the pneumatic chamber thereof connected to a compressed gas source through a pneumatic pressure reducer.

The foregoing construction provides for replenishment of fluid in the hydraulic chambers of the double-acting pneumohydraulic booster in case of leakage of fluid through hydraulic elements of said pneumohydraulic booster.

It is also advisable that the apparatus should incorporate a pneumohydraulic accumulator wherein the pneumatic chamber is connected to the source of compressed gas through the pneumatic pressure reducer, and the hydraulic chamber is connected through the hydraulic check valves to the hydraulic chambers of the single-acting pneumohydraulic boosters.

As a result, leakage existing in the axial compression device can simply and dependably the compensated.

It is likewise advisable that the apparatus is furnished with a pneumohydraulic accumulator the hydraulic chamber whereof is connected through a hydraulic check valve to the two-position four-way distribution valve and to the double-acting pneumohydraulic booster by the bridge of the hydraulic check valves and by the hydraulic drive fluid/shaping fluid separators.

This feature will provide for quite simple and reliable replenishment of fluid in the clamping and sealing assembly in case the hydraulic cylinders thereof are leaky.

It is advisable that the axial compression device be fitted with a pneumatic pressure regulator the inlet whereof communicates with one of said two-position pneumohydraulic distribution valves, and the outlet whereof communicates with the pneumatic chamber of the single-acting pneumohydraulic booster the movable link whereof is connected to the other movable link of one of said hydraulic cylinders.

Such design permits control of the axial compressive force within a certain range, with said axial force being a function of the pressure produced inside the pipe blank to provide for an optimum stress of the pipe blank material whereby the quality of the ready articles is greatly improved.

It is equally preferable that the shaping fluid feeding device hydraulic distribution gear should be constructed in the form of a bridge of hydraulic check valves directly communicating with the hydraulic chambers of the double-acting pneumohydraulic booster, and the hydraulic chambers of said double-acting pneumohydraulic booster should communicate with each other through said bridge of the hydraulic check valves.

This feature modifies the apparatus which is simpler in construction because no fluid separator is required.

Thus, the apparatus for manufacture of corrugated pipes of the present invention is relatively small in size and is simpler in construction as compared to the prior-art apparatus because the pressure producing means is more compact, is used commonly by all the apparatus facilities and is made in the form of a double-acting pneumohydraulic booster rated at a smaller volume of fluid.

In addition, the apparatus of the present invention is economically efficient since it utilizes the energy of compressed gas and requires little electric power, with the compressed gas energy consumption controlled automatically to a high degree of efficiency.

Furthermore, the apparatus herein disclosed provides for a higher quality of ready articles, minimum rejects and higher production output due to high stability of the working cycles where no high-frequency fluctuations occur, due to optimum loads acting on said pipe blank material under pressure and axial compression, and also due to optimum rates of the working cycles.

The apparatus of the invention is highly dependable in service because its construction is simple, several pumps are not required, temperature conditions are stable, and shaping fluid does not affect the members of said apparatus.

The apparatus of this invention permits reducing the occupied productional area by reducing the dimensions of the apparatus.

The invention will now be described in greater detail with reference to preferred embodiments thereof taken in conjunction with the accompanying drawings, wherein.

Figure 1:
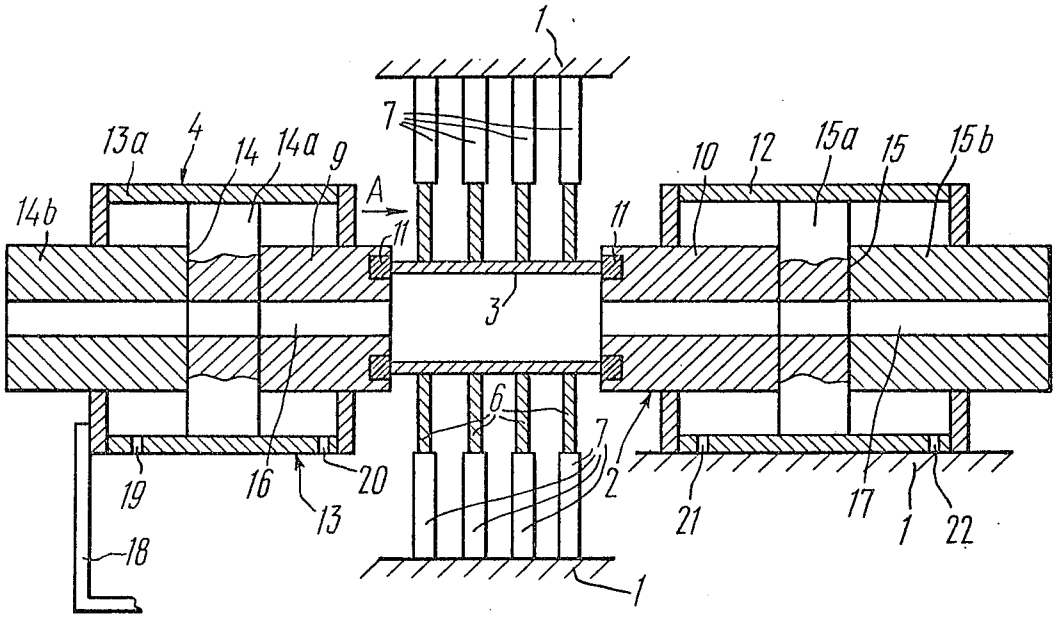
FIG. 1 is a schematic view of an apparatus for manufacture of corrugated pipes according to the invention, wherein hydraulic and pneumatic systems are not shown.

An apparatus for manufacture of corrugated pipes devised according to the present invention comprises a stand 1 (FIG. 1) whereupon an assembly 2 for clamping and sealing a pipe blank 3, incorporating a hydraulic drive 4 is disposed.

The apparatus also comprises a device 5 (FIG. 2) for axial compression of the pipe blank 3, mounted on the stand 1.

The apparatus includes tools 6 (FIG. 1) attached to holders 7 also mounted on the stand 1. In addition, the apparatus is furnished with a device 8 (FIG. 2) for feeding compressed fluid used to shape currugated pipes.

Referring to FIG. 1, the clamping and sealing assembly 2 is fitted with two clamps 9 and 10 contrived in the form of cylinders and positioned coaxially at a definite distance from each other for locating the pipe blank 3 between them in axially aligned position. Sealing rings 11 built into end surfaces of the clamps 9 and 10 mate with the respective ends of the pipe blank 3.

The tools 6 are installed on the holders 7 symmetrically to the compression direction, i.e., to the longitudinal axis of the pipe blank 3. The holders 7 arranged on the stand 1 are reciprocating laterally to said direction of compression and are actuated by a drive (not shown) of any suitable design to effect partial embracing of the pipe blank 3 by the tools 6 during shaping procedure.

The tools 6 are in the given case made in the form of rings bearing the same ref. No. 6, the inside surfaces whereof envelop the pipe blank 3. The rings 6 are located on the axis of the pipe blank 3 at equal distances from each other. The number of the rings 6 depends on the number of corrugations to be formed on the ready article. Each ring 6 includes two half-rings moved relative to each other by the holders 7 actuated by the drive thereof.

In other cases, the tools 6 may be shaped in a different manner.

The hydraulic drive 4 of the clamping and sealing assembly 2 comprises two hydraulic cylinders 12 and 13 furnished with movable links 14,15 consisting of pistons 14*a*, 15*a*, and rods 14*b*, 15*b* axially aligned with the clamps 9 and 10.

Each piston 14*a* and 15*a* is made integral with the respective clamp 9 and 10. Axial through passages 16 and 17 machined in the pistons 14*a*, 15*a* and in the rods 14*b*, 15*b* have a cross-section diameter equal to the inner diameter of each cylindrical clamp 9 and 10.

A case of the hydraulic cylinder 12 is rigidly attached to the stand 1, whereas a case 13*a* constituting another movable link of the hydraulic cylinder 13 is reciprocally mounted on the stand 1 and is driven by the device 5 for axial compression of the pipe blank 3, whereby a permanent contact between the end surfaces of the clamps 9 and 10 and the end surfaces of the pipe blank 3 is maintained at a required axial force during corrugating procedure while the length of the pipe blank 3 is reduced.

The case 13*a* of the hydraulic cylinder 13 carries a lever 18 that moves the hydraulic cylinder 13 under the action of the device 5 for axial compression of the pipe blank 3.

Each case of the hydraulic cylinders 12 and 13 is provided with two ports 19 and 20 or 21 and 22, respectively, through which the chambers of the hydraulic cylinders 12 and 13 communicate with the device 8 used for feeding compressed fluid for shaping the corrugations. This method of connection permits displacement of the pistons 14*a* and 15*a* together with the clamps 9 and 10 which clamp and seal the pipe blank 3.

The hydraulic drive 4 also comprises a pneumohydraulic double-acting booster 23 (FIG. 2) which converts the energy of compressed gas into the pressure of fluid contained in said hydraulic drive 4. The booster 23 may be of any suitable design not discussed herein for easier understanding of the present invention.

Hydraulic chambers 24 of the booster 23 are connected to the respective chambers of the hydraulic cylinders 12 and 13 through a hydraulic distribution gear 25 for imparting motion to the movable links 14 and 15 of the hydraulic cylinders 12 and 13 when the pipe blank 3 is to be clamped and sealed.

Pneumatic chambers 26 of the booster 23 communicate through a pneumatic gear composed of a two-position pneumoelectric distribution valve 28 series-connected through a line 27 and coupled with an electric power source (not shown) and of a pressure reducer 29 which in its turn is connected to a compressed gas source 31 through a line 30.

The axial compression device 5 comprises two single-acting pneumohydraulic boosters 32 and 33 that convert the energy of compressed gas into mechanical movement of movable links 34 and 35 fitted to said boosters of any known suitable design.

Hydraulic chambers 32*a* and 33*a* of the boosters 32 and 33 communicate with each other through series-connected hydraulic distribution valve 36 coupled with the power supply source, and flow controller 37. Besides, said hydraulic chambers 32*a* and 33*a* communicate with each other through a hydraulic check valve 38.

The function of the hydraulic distribution valve 36 is to connect and disconnect the hydraulic chambers 32*a* and 33*a*, and the function of the flow controller 37 is to regulate flow of fluid inside the hydraulic drive 4 from one hydraulic chamber 32*a* or 33*a* to the other chamber 33*a* or 32*a*, respectively. The hydraulic check valve 38 permits fluid contained in the hydraulic drive 4 to flow only from the hydraulic chamber 33*a* to the hydraulic chamber 32*a* because an outlet of said hydraulic check valve 38 is connected to the hydraulic chamber 32*a* of the booster 32, wherein the movable link 34 is kinematically coupled by the lever 18 with the other movable link 13 a, i.e., with the case of the hydraulic cylinder 13 in the clamping and sealing assembly 2. The hydraulic distribution valve 36, flow controller 37 and hydraulic check valve 38 may be of any known design suitable for the purpose.

In addition, the axial compression device 5 comprises two two-position pneumoelectric distribution valves 39 and 40 the outlets whereof are connected to pneumatic chambers 32*b* and 33*b* of the boosters 32 and 33 through lines 41 and 42 and the inlets whereof are connected to the compressed gas source 31 through the line 30. The two-position pneumoelectric distribution valves 39 and 40 serve to connect the pneumatic chambers 32*b* and 33*b* of the boosters 32 and 33 to the compressed gas source 31 to effect displacement of the movable links 34 and 35 thereof, or to communicate with atmosphere the pneumatic chambers 32*b* and 33*b* thereof.

The two-position pneumoelectric distribution valves 39 and 40 are also connected to the electric power source and are designed in any known way suitable for the given purpose.

The apparatus disclosed herein is furnished with the compressed shaping fluid feeding device 8 designed in any suitable manner and incorporates a two-position hydraulic distribution valve 43 operating from the electric power source and serving for connection of the hydraulic chambers 24 in the double-acting pneumohydraulic booster 23 to the internal space of the pipe blank 3. An inlet of the two-position hydraulic distribution valve 43 is connected to the hydraulic chambers 24 of the booster 23 through a line 44 and through the hydraulic distribution gear 25.

Furthermore, the compressed shaping fluid feeding device 8 includes a pressure regulator 45 which controls the pressure of shaping fluid delivered into the pipe blank 3. The pressure regulator 45 can be of any design suitable for the purpose. An inlet of the pressure regulator 45 communicates with the outlet of the two-position hydraulic distribution valve 43, and an outlet thereof is connected through the through passage 17 (FIG. 1) in the movable link 15 of the hydraulic cylinder 12 to the internal space of the pipe blank (3).

Besides, the compressed shaping fluid feeding device 8 incorporates a source 46 (FIG. 2) of shaping fluid, connected to the outlet of the pressure regulator 45 through a hydraulic distribution and adjustment gear 47.

The hydraulic distribution gear 25 comprises a bridge 48 of hydraulic check valves 48*a*, 48*b*, 48*c* and 48*d*, and hydraulic drive fluid/shaping fluid separators 49*a* and 49*b*. The hydraulic check valves 48*a*, 48*b*, 48*c* and 48*d* permit hydraulic drive fluid to flow only in one direction to the hydraulic cylinders 12 and 13 to be actuated, to the two-position hydraulic distribution valve 43 in the compressed shaping fluid feeding device 8, and also permit drain of hydraulic drive fluid out of the hydraulic cylinders 12 and 13.

The hydraulic drive fluid/shaping fluid separators 49*a* and 49*b* serve for preventing contact between the heterogeneous fluids and, hence, do not allow them to mix.

The check valves 48*a*, 48*b*, 48*c* and 48*d* and the hydraulic drive fluid/shaping fluid separators 49*a* and 49*b* may be of any known design suitable for the purpose.

Each hydraulic drive fluid/shaping fluid separator 49*a* and 49*b* communicates with the respective hydraulic chamber 24 in the double-acting pneumohydraulic booster 23. Said chambers 24 in turn communicate through lines 50 and 51, the hydraulic distribution gear 25 and a two-position four-way distribution valve 52 connected to the bridge 48 of the hydraulic check valves 48*a*, 48*b*, 48*c* and 48*d* with the respective chambers of the hydraulic cylinders 12 and 13. The two-position four-way distribution valve 52 connected to the electric power source controls movement of the movable links 14 and 15 in the hydraulic cylinders 12 and 13, and can be designed in any suitable manner.

The hydraulic distribution and adjustment gear 47 of the compressed shaping fluid feeding device 8 comprises a hydraulic drive fluid/shaping fluid separator 53, a two-position hydraulic distribution valve 54 and a hydraulic pressure reducer 55. The hydraulic drive fluid/shaping fluid separator 53 serves for preventing the contact between said heterogeneous fluids, and may be of any design suitable for the purpose. The two-position hydraulic distribution valve 54 is used for connecting and disconnecting the shaping fluid source 46 with the hydraulic drive fluid/shaping fluid separator. The hydraulic distribution valve 54 may be of any known design suitable for the purpose.

The function of the hydraulic pressure reducer 55 is to control the pressure of shaping fluid delivered from the shaping fluid source 46 to the hydraulic drive fluid/shaping fluid separator 53, and may be of any design suitable for the purpose.

The hydraulic drive fluid/shaping fluid separator 53 is connected to the pressure regulator 45 which is in its turn connected to the internal space of the pipe blank 3. The hydraulic drive fluid/shaping fluid separator 53 also communicates with the two-position hydraulic distribution valve 54 which is connected through the hydraulic pressure reducer 55 and also through a pump 56 and a filter 57 to the fluid source 46 for shaping. The filter 57 fulfils the function of filtering shaping fluid delivered by said pump 56 from the shaping fluid source 46. The pump 56 is a low-displacement unit serving for low-rate feed of shaping fluid into the hydraulic drive fluid/shaping fluid separator 53 to compensate for losses of shaping fluid resulting from wetting the surfaces of articles being corrugated.

If the dimensions of the double-acting pneumohydraulic booster 23 are to be minimum, it is expedient that the hydraulic drive fluid/shaping fluid separator 53 (FIG. 3) be designed in the form of a hydraulic booster (bearing the same ref. No. 53) incorporating a movable link 58 composed of a piston 58*a* and a plunger 58*b* rigidly coupled to each other.

The piston 58*a* is installed in the chamber 53*a* of the hydraulic booster 53 filled with the hydraulic drive fluid, and the plunger 58*b* is arranged inside the chamber 53*b* filled with shaping fluid. The hydraulic booster results from the fact that the cross-sectional area of the chamber 53*a* exceeds that of the plunger 58*b*, whereby the pressure in the chamber 53*b* id higher than that in the chamber 53*a* so many times as the cross-sectional area of the plunger 58*b* is smaller than that of the chamber 53*a*.

The foregoing design permits producing a required pressure inside the pipe blank 3 although the pressure is low in the pneumohydraulic booster 23, the size whereof can be considerably minimized in this case.

The apparatus according to the present invention comprises a pneumohydraulic accumulator 59 (FIG. 2) separated into a hydraulic chamber 59*a* and a pneumatic chamber 59*b* and designed for replenishment with the hydraulic drive fluid of the hydraulic chambers 24 of the double-acting pneumohydraulic booster 23 in the event of leakage. The design of said pneumohydraulic accumulator is optional and suitable for the purpose.

The hydraulic chamber 59*a* of the pneumohydraulic accumulator 59 communicates with the hydraulic chambers 24 in the double-acting pneumohydraulic booster 23 through controlled hydraulic valves 60 and 61 which pass fluid in one direction only to the hydraulic chambers 24 of the double-acting pneumohydraulic booster 23, with said controlled hydraulic valves being of any known design suitable for the given purpose.

The pneumatic chamber 59*b* in the pneumohydraulic accumulator 59 communicates with the compressed gas source 31 through a pneumatic pressure reducer 62 which controls the gas pressure in the pneumatic chamber 59*b*, and can be of any known design.

Replenishment of fluid in the pneumohydraulic single-acting boosters 32 and 33 of the axial compression device 5 is accomplished in the same way. For this purpose, a pneumohydraulic accumulator 63 similar in design to the pneumohydraulic accumulator 59 is provided.

A pneumatic chamber 63*b* in said pneumohydraulic accumulator 63 communicates with the compressed gas source 31 through the pneumatic pressure reducer 62, and a hydraulic chamber 63*a* thereof communicates with the hydraulic chambers 32*a* and 33*a* in the single-acting pneumohydraulic boosters 32 and 33 through hydraulic check valves 64 and 65, respectively. The hydraulic check valves 64 and 65 serve for one-way connection of the hydraulic chamber 63*a* in the pneumohydraulic accumulator 63 to the hyraulic chambers 32*a* and 33*a* in the single-acting pneumohydraulic boosters 32 and 33, and may be of any known design suitable for this purpose.

To compensate for leakage of hydraulic drive fluid in the hydraulic cylinders 12 and 13, use is made of a pneumohydraulic accumulator 66, a hydraulic chamber 66*a* whereof is connected through a check valve 67 to the two-position four-way distribution valve 52 and to the double-acting pneumohydraulic booster 23 through the bridge 48 of the check valves 48*a*, 48*b*, 48*c* and 48*d*, and through the hydraulic drive fluid/shaping fluid separators 49*a* and 49*b*.

Figure 2:
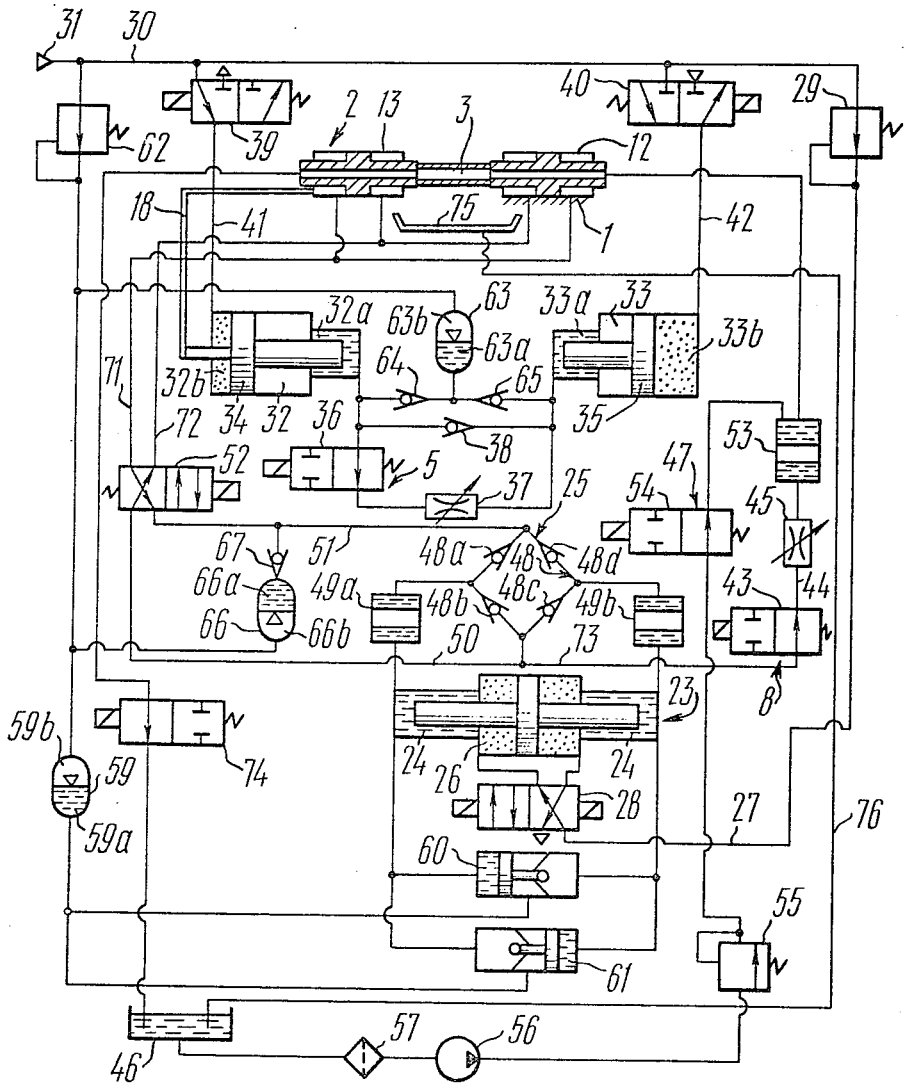
FIG. 2 is a pneumohydraulic schematic diagram of the apparatus for manufacture of corrugated pipes according to the present invention, drawn to a smaller scale.
Figure 3:
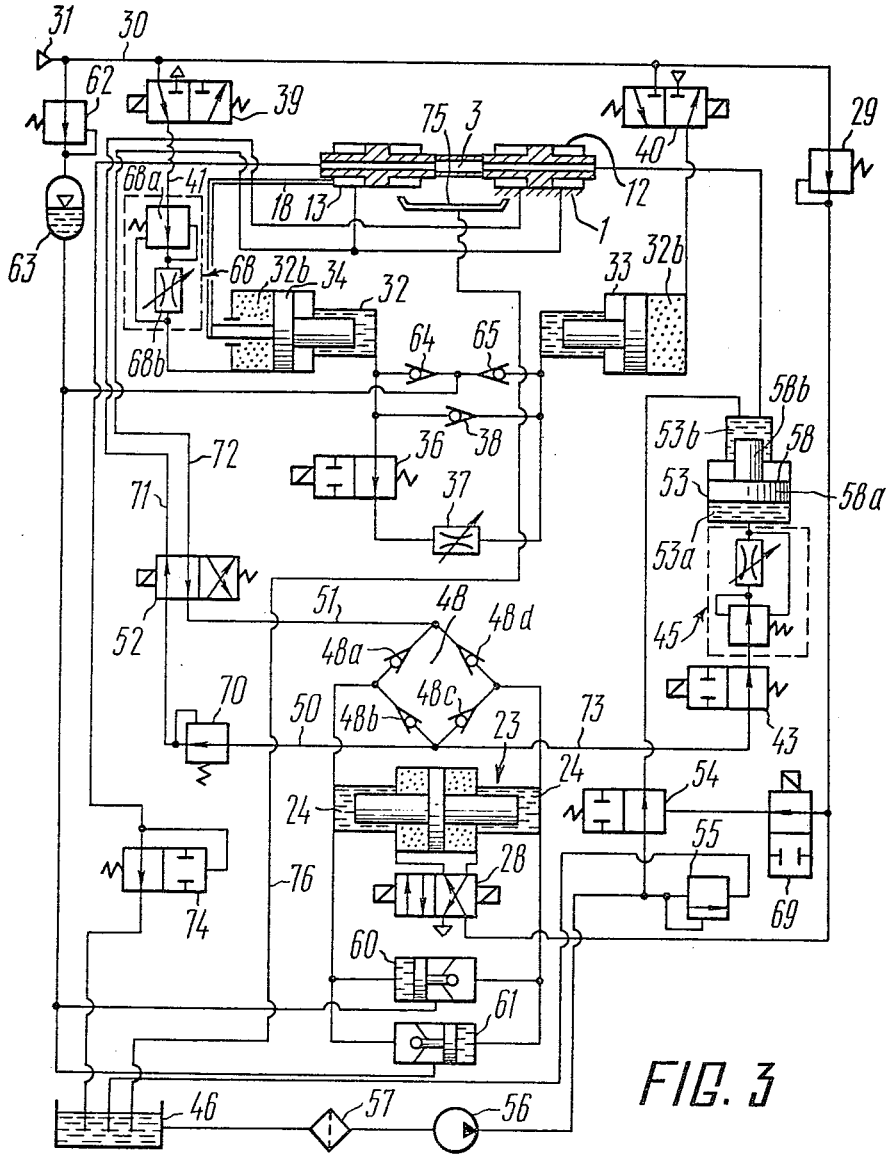
FIG. 3 is a pneumohydraulic schematic diagram of another embodiment of the apparatus according to the invention, drawn to a smaller scale.

The apparatus for manufacture of corrugated pipes herein discussed can be embodied differently as presented in FIG. 3. Referring to FIG. 3, the apparatus comprises the same assemblies and devices as the foregoing embodiment illustrated in FIG. 2, with the identical assemblies, devices and members thereof bearing the same ref. Nos.

In the embodiment shown in FIG. 3, the axial compression device 5 incorporates a pneumatic pressure regulator 68 comprising series-connected pneumatic pressure reducer 68*a* and a choke 68*b*.

The purpose of said pressure regulator 68 is to control the pressure and flow rate of compressed gas supplied from the compressed gas source 31 to the pneumatic chamber 32*b* of the single-acting pneumohydraulic booster 32 for adjusting the axial compression of the pipe blank 3. In other embodiments, the regulator 68 may be of any known design suitable for the purpose. An inlet of the pressure regulator 68 is connected to the two-position pneumoelectric distribution valve 39, and an outlet thereof is connected to the pneumatic chamber 32*b* in the single-acting pneumohydraulic booster 32, the movable link 34 whereof is associated with the other movable link 13*a* of the hydraulic cylinder 13 through the lever 18.

The hydraulic distribution gear 25 of the shaping fluid feeding device 8 in the embodiment of the invention presented in FIG. 3 is essentially a bridge 48 of the hydraulic check valves 48*a*, 48*b*, 48*c* and 48*d* which communicate directly with the hydraulic chambers 24 in the double-acting pneumohydraulic booster 23, with the hydraulic chambers 24 interconnected through the bridge 48 of the hydraulic check valves 48*a*, 48*b*, 48*c* and 48*d*.

Besides, the pressure regulator 45 may be devised in the form of series-connected throttle valve 45*a* and hydraulic pressure reducer 45*b*.

The two-position hydraulic distribution valve 43 in the embodiment illustrated in FIG. 3 is pneumatically controlled by a pneumoelectric distribution valve 69 connected to the electric power source and to the compressed air source 31. In this case, the two-position hydraulic distribution valve 43 proves more dependable and resistant to shaping fluid, because corrosion of parts in the two-position hydraulic distribution valve 43 operating from the electric power source and controlled by the known components in the form of an electromagnet fitted to the apparatus of the present embodiment (not shown in the drawing), results in malfunctions during change-over operation. The embodiment of the invention presented in FIG. 3 employs compressed gas control as the gas pressure is commonly sufficient for reliable actuation of the two-position hydraulic distribution valve 43, and the control is more dependable than that effected by the electromagnet of known design.

Referring again to FIG. 3, the bridge 48 of check valves 48*a*, 48*b*, 48*c* and 48*d* communicates with the two-position four-way distribution valve 52 through a pressure regulator 70, whereby the compressive force exerted by the clamps 9 and 10 is controllable, and the pipe blank 3 is clamped and sealed securely. The pressure regulator 70 may be of any design suitable for the purpose.

Given hereinafter is the description of operation of the apparatus for manufacture of corrugated pipes, according to the invention, with reference to the preferred embodiments shown in FIGS. 2 and 3 discussed together because the embodiment of FIG. 3 is a minor modification wherein the operating principle remains unchanged and is similar to that of the apparatus illustrated in FIG. 2. Some specific features in functioning of the apparatus shown in FIG. 3 will be included in the description which follows.

The pipe blank 3 is placed between the tools 6 after the half-rings of the holders 7 are set to motion normal to the direction of compression applied to the pipe blank 3 by the drive. Each pair of half-rings embraces the pipe blank 3 and forms a ring which envelop the pipe blank 3 as is shown in FIG. 1.

When an electric signal is sent from the control system (not shown) to the two-position pneumoelectric distribution valve 28, compressed gas supplied from the compressed gas source 31 through the line 30, the pressure reducer 29, the pneumatic line 27 and through said two-position pneumoelectric distribution valve 28 is injected into the right-hand or left-hand pneumatic chamber 26 of the double-acting pneumohydraulic booster 23 according to the polarity of the signal applied.

Then the control signal is forwarded from the control system for mobilizing the two-position four-way distribution valve 52 which moves to the position opposite to that shown in FIG. 2. Now fluid of the hydraulic drive 4 flows from one hydraulic chamber 24 of the double-acting pneumohydraulic booster 23 through the separator 49*a* or 49*b*, the hydraulic check valve 48*b* or 48*c* of the check valve bridge 48, through the line 50, said two-position four-way distribution valve 52 and a hydraulic line 71 to the ports 22 and 19 of the respective chambers of the hydraulic cylinders 12 and 13. The movable links 14 and 15 of the hydraulic cylinders 12 and 13 move toward each other together with the clamps 9 and 10 due to the pressure of hydraulic drive fluid acting upon the pistons 14*a* and 15*a*. Thus, the sealing rings 11 closely contact the end surfaces of the pipe blank 3 whereby the latter is clamped and sealed. In the embodiment illustrated in FIG. 3, the clamping force can be adjusted where necessary by means of the regulator 70 of fluid pressure in the hydraulic drive 4.

Hydraulic drive fluid contained in other chambers of the hydraulic cylinders 12 and 13 is forced out through ports 20 and 21, and is directed through a line 72, through the two-position four-way distribution valve 52, the line 51, and the hydraulic check valve 48*a* or 48*d* of the check valve bridge 48 to the hydraulic drive fluid/shaping fluid separator 49*a* or 49*b*.

Then the control system supplies a control signal to the two-position hydraulic distribution valve 43 which moves to the position shown in FIGS. 2 and 3. In this case, hydraulic drive fluid supplied from one hydraulic chamber 24 of the double-acting pneumohydraulic booster 23 through the separator 49*a* or 49*b*, the hydraulic check valve 48*b* or 48*c* of the check valve bridge 48, through a line 73, two-position hydraulic distribution valve 43 and the pressure regulator 45 is injected into the hydraulic drive fluid-shaping fluid separator 53.

Shaping fluid is then forwarded to the internal space of the pipe blank 3 through the through passage 17 machined in the movable link 15 of the hydraulic cylinder 12 and clamp 10. Air trapped in the pipe blank 3 is forced out by shaping fluid through the axial passage 16 in the movable link 14 of the hydraulic cylinder 13 and is then sent to the shaping fluid source through a cutoff valve 74 already placed by the control system to the position shown in FIGS. 2 and 3.

After air is expelled from the internal space of the pipe blank 3 (FIG. 1), the cutoff hydraulic valve 74 closes, and a pressure inside the pipe blank 3 is built up according to adjustment of the pressure regulator 45.

Then the control system sends an electric control signal to the two-position pneumoelectric distribution valve 39 which is now placed to the position shown in FIG. 2. Compressed gas supplied from the compressed gas source 41 is injected through the line 41 into the pneumatic chamber 32*b* of the single-acting pneumohydraulic booster 32. The two-position pneumoelectric distribution valve 40 responds to the signal supplied from the control system and moves to the position shown in FIG. 2, whereat the pneumatic chamber 33*b* communicates with atmosphere.

When an electric control signal is sent from the control system, the hydraulic distribution valve 36 moves to the position shown in FIG. 2. In this case, hydraulic drive fluid starts flowing from the hydraulic chamber 32*a* of the single-acting pneumohydraulic booster 32 to the hydraulic chamber 33*a* of the single-acting pneumohydraulic booster 33, whereby the movable link 34 of the single-acting pneumohydraulic booster 32 and the other movable link 13*a* (FIG. 1) of the hydraulic cylinder 13 coupled with it by the lever 18 is also set to motion. As the case 13*a* of the hydraulic cylinder 13 travels, an axial compressing force is applied to the pipe blank 3 at a rate which depends on adjustment of the flow controller 37. In the embodiment presented in FIG. 3, a respective adjustment control of the pneumatic pressure regulator 68 permits adjusting the axial compressing force, and not only the rate thereof.

As the shaping fluid pressure is acting on the pipe blank 3 from inside, and the axial compressing force is exerted on the outside, the pipe blank material expands radially, and the pipe blank adopts the shape of the ready article which depends on the shape of the tools 6.

On completion of the corrugating procedure, the control system moves the two-position pneumoelectric distribution valves 39, 40 to the positions opposite to those indicated in FIG. 2. The hydraulic distribution valve 36, the two-position hydraulic distribution valve 43, the two-position four-way distribution valve 52 and the cutoff valve are also moved to other positions.

At this stage, no shaping fluid is supplied into the pipe blank. The movable link 35 in the single-acting pneumohydraulic booster 33 starts moving and forcing out hydraulic drive fluid from the hydraulic chamber 33*a* to the hydraulic chamber 32*a* of the single-acting pneumohydraulic booster 32 through the hydraulic check valve 38, whereby the movable link 34 and the other movable link 13*a* of the hydraulic cylinder 13 coupled to the former by the lever 18 are set to motion.

When the hydraulic cylinder moves, the clamp 9 is driven away from the end surface of the ready article.

Shaping fluid flowing outside from the ready article is directed to a pan 75 (FIG. 2) serving for collecting shaping fluid released from the ready article, and is then forwarded to the shaping fluid source 46 through a line 76.

Hydraulic drive fluid flowing through the line 50, the two-position four-way distribution valve 52, the line 72 and the ports 20 and 21 is delivered into the hydraulic cylinders 12 and 13, and thus causes the movable links 14 and 15 together with the clamps 9 and 10 to move to the initial positions.

Then the tools 6 are retracted by the holders 7 and the ready article is removed from the apparatus.

The apparatus is now ready to begin another cycle of manufacturing corrugated pipes.

If leakage exists in the hydraulic gear of the apparatus, lost fluid is replenished automatically. The pneumatic chambers 59*b*, 63*b* and 66*b* in the pneumohydraulic accumulators 59, 63 and 66 are permanently connected to the compressed gas source 31 through the pneumatic pressure reducer 62, and the hydraulic chambers 59*a*, 63*a* and 66*a* communicate with the respective hydraulic equipment which sewes for replenishment of fluid in case of leakage.

Since the loss of shaping fluid is inevitable due to wetting of the pipe blank surfaces, shaping fluid contained in the hydraulic drive fluid/shaping fluid separator 53 must be replenished repeatedly. This requirement is satisfied by sending a signal from the control system to the two-position hydraulic distribution valve 54 or to the pneumoelectric distribution valve 69 (FIG. 3). Replenishment fluid is delivered by the pump 56 from the shaping fluid source 46 through the filter 57, and further through the hydraulic pressure reducer 55 and two-position hydraulic distribution valve 54 to the hydraulic drive fluid/shaping fluid separator 53.

An experimental apparatus for manufacture of corrugated pipes has been successfully tested, with the test results showing that the power requirements of the apparatus are cut down 10 to 15 times. The accuracy in geometrical dimensions of bellows manufactured by the apparatus has been improved by one or two accuracy grades, and the apparatus service life have been extended by 20 to 30 percent.

The apparatus for manufacture of corrugated pipes herein disclosed permits reducing the labor requirements by two or three times, and bringing the number of rejects down to 1 or 2 percent.

The apparatus proved highly dependable in service and simple for maintenance. As the apparatus is quite compact, the productional area occupied by the apparatus is reduced by 10 to 15 percent.

Various modifications may be made in the invention by those skilled in the art without departing from the spirit thereof, with said apparatus described hereinabove as a preferred embodiment.

What is claimed is:

1. An apparatus for manufacture of corrugated pipes, comprising: a stand; a pipe blank clamping and sealing assembly mounted upon said stand; a hydraulic drive of said clamping and sealing assembly, mounted upon said stand; a pipe blank axial compression device mounted upon said stand; a shaping fluid source; an electric power source; a device for feeding compressed shaping fluid from said shaping fluid source to the internal space of a pipe blank, said device being mounted on said stand, tools arranged on said stand symmetrically relative to the direction of compression of said pipe blank and reciprocating across said direction of compression for at least partial embracing of said pipe blank; and a drive for reciprocal movement of said shaping tools; said clamping and sealing assembly incorporating two clamps positioned coaxially at a certain distance from each other for locating said pipe blank between them; said hydraulic drive of said clamping and sealing assembly comprising: a source of compressed gas, hydraulic cylinders wherein a movable link of each said hydraulic cylinder is provided with a through passage, said movable link in each said hydraulic cylinder being mechanically coupled with respective one of two clamps for clamping and sealing said pipe blank, and the other movable link in one said hydraulic cylinder serving for axial compression of said pipe blank; a double-acting pneumohydraulic booster the hydraulic chambers whereof communicate with the respective chambers of said hydraulic cylinders through a hydraulic distribution gear and the pneumatic chambers whereof communicate through a pneumatic gear with said compressed gas source; said axial compression device being made in the form of at least one pneumohydraulic booster and at least one two-position pneumoelectric distribution valve connected to said electric power source, said at least one two-position pneumoelectric distribution valve having its outlet in communicating with a pneumatic chamber of at least one pneumohydraulic booster controlling the movement of said other movable link of one of said hydraulic cylinders and its inlet in communication with said compressed gas source; said shaping fluid feeding device including: a pressure regulator communicating through a hydraulic distribution and adjustment gear with said shaping fluid source and with the internal space of said pipe blank through an open-end passage machined in said movable link of the other of said hydraulic cylinders, and a two-position hydraulic distribution valve connected to said electric power source and having its inlet in communication with hydraulic chambers of said pneumohydraulic double-acting booster through the hydraulic distribution gear, and its outlet in communication with said pressure regulator.

2. An apparatus as claimed in claim 1, wherein said axial compression device comprises two single-acting pneumohydraulic boosters and hydraulic chambers whereof are interconnected through series-connected hydraulic distribution valve connected to said electric power source, and flow controller, and communicate with each other directly through a hydraulic check valve the outlet whereof is connected to the hydraulic chamber of that single-acting pneumohydraulic booster wherein the movable link is kinematically associated with said other movable link of one of said hydraulic cylinders.

3. An apparatus as claimed in claim 1, wherein said hydraulic distribution gear comprises a bridge of hydraulic check valves and hydraulic drive fluid/shaping fluid separators, each separator communicating with the respective hydraulic chamber of said double-acting pneumohydraulic booster, the hydraulic chambers whereof are in turn connected to the respective chambers of said hydraulic cylinders through said hydraulic distribution gear and a two-position four-way distribution valve connected to said hydraulic check valve bridge of said gear and to said electric power source.

4. An apparatus as claimed in claim 1, wherein said hydraulic distribution and adjustment gear of said shaping fluid feeding device comprises a hydraulic drive fluid/shaping fluid separator, connected to said pressure regulator and to the internal space of said pipe blank, and a two-position hydraulic distribution valve connected to said separator, and also to said shaping fluid source through a hydraulic pressure reducer.

5. An apparatus as claimed in claim 4, wherein said hydraulic drive fluid/shaping fluid separator is devised as a hydraulic booster an outlet chamber whereof communicates with the internal space of said pipe blank.

6. An apparatus as claimed in claim 2, comprising a pneumohydraulic accumulator the hydraulic chamber whereof communicates with the hydraulic chambers of said double-acting pneumohydraulic booster through controlled hydraulic valves and a pneumatic chamber whereof is connected through a pneumatic pressure reducer to said compressed gas source.

7. An apparatus as claimed in claim 2, comprising a pneumohydraulic accumulator a pneumatic chamber whereof is connected through said pneumatic pressure reducer to said compressed gas source and a hydraulic chamber whereof is connected through hydraulic check valves to the hydraulic chambers of said single-acting pneumohydraulic boosters.

8. An apparatus as claimed in claim 2, comprising a pneumohydraulic accumulator a hydraulic chamber whereof is connected through a hydraulic check valve to said two-position four-way distribution valve and to said double-acting pneumohydraulic booster through said hydraulic check valve bridge and said hydraulic drive fluid/shaping fluid separators.

9. An apparatus as claimed in claim 2, wherein said axial compression device incorporates a pneumatic pressure regulator the inlet whereof is connected to one of the two-position pneumoelectric distribution valves and the outlet whereof is connected to the pneumatic chamber of that single-acting pneumohydraulic booster wherein said movable link is mated with said other movable link of one of said hydraulic cylinders.

10. An apparatus as claimed in claim 2, wherein said hydraulic distribution gear of said shaping fluid feeding device is made in the form of a bridge of hydraulic check valves connected directly to the hydraulic chambers of said double-acting pneumohydraulic booster, with the hydraulic chambers of said double-acting pneumohydraulic booster communicating with each other through said hydraulic check valve bridge.

11. An apparatus as claimed in claim 9, wherein said hydraulic distribution gear of said shaping fluid feeding device is made in the form of a bridge of hydraulic check valves directly connected to said hydraulic chambers of said double-acting pneumohydraulic booster, with said hydraulic chambers of said double-acting pneumohydraulic booster communicating with each other through said hydraulic check valve bridge.

* * * * *